US009238872B2

(12) United States Patent
Mori et al.

(10) Patent No.: US 9,238,872 B2
(45) Date of Patent: Jan. 19, 2016

(54) METHOD FOR SYNTHESIZING FLUORINE COMPOUND BY ELECTROLYSIS AND ELECTRODE THEREFOR

(75) Inventors: Isamu Mori, Ube (JP); Akifumi Yao, Ube (JP); Akiou Kikuchi, Ube (JP); Masaaki Yonekura, Matsusaka (JP); Hiroshi Horiuchi, Matsusaka (JP)

(73) Assignee: Central Glass Company, Limited, Ube-shi (JP)

( * ) Notice: Subject to any disclaimer, the term of this patent is extended or adjusted under 35 U.S.C. 154(b) by 98 days.

(21) Appl. No.: 13/985,242

(22) PCT Filed: Jan. 27, 2012

(86) PCT No.: PCT/JP2012/051766

§ 371 (c)(1),
(2), (4) Date: Aug. 13, 2013

(87) PCT Pub. No.: WO2012/124384

PCT Pub. Date: Sep. 20, 2012

(65) Prior Publication Data

US 2013/0341202 A1 Dec. 26, 2013

(30) Foreign Application Priority Data

Mar. 17, 2011 (JP) ..... 2011-058633

(51) Int. Cl.
*C25B 11/04* (2006.01)
*C25D 3/66* (2006.01)
(Continued)

(52) U.S. Cl.
CPC ..... *C25B 11/0478* (2013.01); *C25B 1/245* (2013.01); *C25B 11/12* (2013.01); *C25D 3/66* (2013.01); *C25D 9/06* (2013.01)

(58) Field of Classification Search
CPC ..... C25B 11/0405; C25B 11/0447; C02F 2001/46147; C02F 2001/46142; C25C 7/025; C25D 17/10; C25D 5/02; C25D 7/123; C25D 1/003; C25D 5/10; C25D 7/0642; C25D 9/04
USPC ..... 204/242, 280; 205/350, 140, 154, 225, 205/300, 170, 171, 324
See application file for complete search history.

(56) References Cited

U.S. PATENT DOCUMENTS 3,956,194 A * 5/1976 Armand ..... 252/507
5,160,415 A * 11/1992 Kondo et al. ..... 205/411
(Continued)

FOREIGN PATENT DOCUMENTS

JP 2006-249557 A 9/2006
JP 2010-18849 A 1/2010
JP 2011-46994 A 3/2011

OTHER PUBLICATIONS

English Translation of JP2011-046994 to Kazuma (Mar. 10, 2011).*
(Continued)

*Primary Examiner* — Zulmariam Mendez
(74) *Attorney, Agent, or Firm* — Crowell & Moring LLP

(57) ABSTRACT

Disclosed is an electrode for electrolytic synthesis of a fluorine compound, including: an electrode substrate having at least a surface thereof formed of a conductive carbon material; a conducting diamond layer formed on a part of the surface of the electrode substrate; and a metal fluoride-containing coating layer formed on an exposed part of the electrode substrate that is uncovered by the conducting diamond layer. It is possible for the electrolytic synthesis electrode to limit the growth of a graphite fluoride layer on the electrode surface, prevent decrease in effective electrolysis area and allow stable electrolysis in an electrolytic bath of a hydrogen fluoride-containing molten salt.

4 Claims, 1 Drawing Sheet

(51) Int. Cl.

| | |
|---|---|
| ***C25D 9/06*** | (2006.01) |
| ***C25B 11/12*** | (2006.01) |
| ***C25B 1/24*** | (2006.01) |

(56) References Cited

U.S. PATENT DOCUMENTS

| | | | | |
|---|---|---|---|---|
| 2006/0066203 | A1 * | 3/2006 | Uno | C02F 1/46109 313/311 |
| 2006/0219570 | A1 | 10/2006 | Furuta et al. | |
| 2010/0006449 | A1 | 1/2010 | Tasaka | |

OTHER PUBLICATIONS

Redkin (Electrical conductivity of molten mixtures of potassium and sodium fluorides with calcium fluoride; pp. 1949-1954).*

Corresponding International Search Report with English Translation dated Feb. 28, 2012 (three (3) pages).

"Geometrical Product Specifications (GPS) Surface Texture: Profile Method Terms, Definitions and Surface Texture Parameters", JIS B 0601 : 2001, 1997, pp. 262-287.

Japanese-language Written Opinion dated Feb. 28, 2012 (PCT/ISA/237) (four (4) pages).

* cited by examiner

METHOD FOR SYNTHESIZING FLUORINE COMPOUND BY ELECTROLYSIS AND ELECTRODE THEREFOR

TECHNICAL FIELD

The present invention relates to an electrode and method for electrolytic synthesis of a fluorine compound by the use of an electrolytic bath of a hydrogen fluoride-containing molten salt.

BACKGROUND ART

In conventional electrolytic synthesis methods in which fluorine compounds e.g. fluorine, nitrogen trifluoride etc. are produced by electrolysis of hydrogen fluoride in electrolytic baths of hydrogen fluoride-containing molten salts, electrodes of carbon materials are mainly used as anodes. It is however known that, in the case of using such a carbon material electrode in the electrolytic synthesis of the fluorine compound, an insulating layer of graphite fluoride e.g. $(CF)_n$ grows on a surface of the carbon material. When the graphite fluoride layer grows to a large thickness on the surface of the carbon material, the area of contact of the electrode with an electrolytic solution in the electrolytic bath becomes reduced to cause a problem of decrease in current flow (which is so called "anode effect"). There is thus adopted a coating technique to apply a coating layer of conducting diamond, on which the growth of a graphite fluoride layer is unlikely to occur, to a carbon substrate surface of the electrode.

In the conventional coating technique, however, it has been practically difficult to completely cover the carbon substrate surface by the conducting diamond coating layer with no minute defects because the conducting diamond coating applied to the carbon substrate is in polycrystalline form. The diamond coating layer undergoes separation when the carbon substrate wears out due to the entry of the electrolytic solution through minute defects in the diamond coating layer.

As a solution to improve this problem, Patent Document 1 discloses a technique for self stabilization of the electrode by forming a graphite fluoride layer on an exposed part of the electrode substrate to which the diamond coating layer is not applied.

PRIOR ART DOCUMENTS

Patent Documents

Patent Document 1: Japanese Laid-Open Patent Publication No. 2006-249557

SUMMARY OF THE INVENTION

Problems to be Solved by the Invention

As the graphite fluoride layer shows insulation properties and has low surface energy and low wettability to the molten salt in the electrolytic bath, the effective electrolysis area of the electrode decreases with the growth of the graphite fluoride layer. This can cause a rise in electrolysis voltage, abnormal heat generation, poor conduction etc. by increase in the electrical resistance of the electrode itself. Further, there occurs a change in the volume of the electrode itself due to the formation/growth of the graphite fluoride layer so that the electrode may be broken or cracked to cause poor electrolysis. It is thus preferable to minimize the formation of the graphite fluoride layer in terms of the effective electrolysis area of the electrode although it is feasible to allow self stabilization of the electrode and improve poor electrolytic efficiency of the electrode by preferentially forming the graphite fluoride layer e.g. $(CF)_n$ on the exposed part of the electrode substrate as disclosed in Patent Document 1.

As mentioned above, the conventional type of fluorine compound electrolytic synthesis electrode, in which the surface of the electrode substrate is not completely covered by the conducting diamond coating layer, has difficulty in limiting the growth of the graphite fluoride layer on the exposed part of the electrode substrate during the electrolysis and difficulty in preventing the effective electrolysis area of the electrode from decreasing with the gradual growth of the graphite fluoride layer in a long period of the electrolysis.

The present invention has been made in view of the above circumstances. It is accordingly an object of the present invention to provide an electrode for electrolytic synthesis of a fluorine compound, which is capable of limiting the growth of a graphite fluoride layer on a surface of the electrode so as to prevent decrease in the effective electrolysis area of the electrode and allow stable electrolysis. It is also an object of the present invention to provide a method for stable electrolytic synthesis of a fluorine compound.

Means for Solvent the Problems

The present inventors have found that, as a solution to the above problems, it is possible to provide an electrode for electrolytic synthesis of a fluorine compound so as to prevent decrease in effective electrolysis area and allow stable electrolysis by forming a metal fluoride-containing coating layer on a surface part of an electrode substrate on which a conducting diamond layer is not formed. The present invention is based on this finding.

Namely, there is provided according to the present invention an electrode for electrolytic synthesis of a fluorine compound by the use of an electrolytic bath of a hydrogen fluoride-containing molten salt, comprising: an electrode substrate having at least a surface thereof formed of a conductive carbon material; a conducting diamond layer formed on a part of the surface of the electrode substrate; and a metal fluoride-containing coating layer formed on an exposed part of the electrode substrate that is uncovered by the conducting diamond layer.

The metal fluoride-containing coating layer is preferably formed of a potassium metal fluoride as represented by the general formula: $K_nMF_m$ (where M is Ni, Fe, Cu, Zn or Al; n is 1 to 3; and m is 1 to 7).

There is also provided according to the present invention a method for electrolytic synthesis of a fluorine compound by immersing an electrolytic electrode as an anode in an electrolytic bath of a hydrogen fluoride-containing molten salt, the electrolytic electrode comprising an electrode substrate having at least a surface thereof formed of a conductive carbon material and a conducting diamond layer formed on a part of the surface of the electrode substrate, wherein the method is characterized by synthesizing the fluorine compound while forming a metal fluoride-containing coating layer on an exposed part of the electrode substrate that is uncovered by the conducting diamond layer.

The electrode for electrolytic synthesis of the fluorine compound according to the present invention is so structured that the metal fluoride-containing coating layer having electrical conductivity and high durability is formed on the exposed surface part of the electrode substrate on which the conducting diamond layer is not formed. It is therefore possible according to the present invention to prevent decrease in the effective electrolysis area of the electrode and allow stable electrolysis in the electrolytic bath of the hydrogen fluoride-containing molten salt.

DETAILED DESCRIPTION OF THE EMBODIMENTS

Hereinafter, the electrode for electrolytic synthesis of the fluorine compound according to the present invention will be described in detail below.

The electrode according to the present invention is embodied as an electrolytic electrode for synthesis of a fluorine compound such as fluorine gas or nitrogen trifluoride gas by the use of an electrolytic bath of a hydrogen fluoride-containing molten salt.

Figure 1:
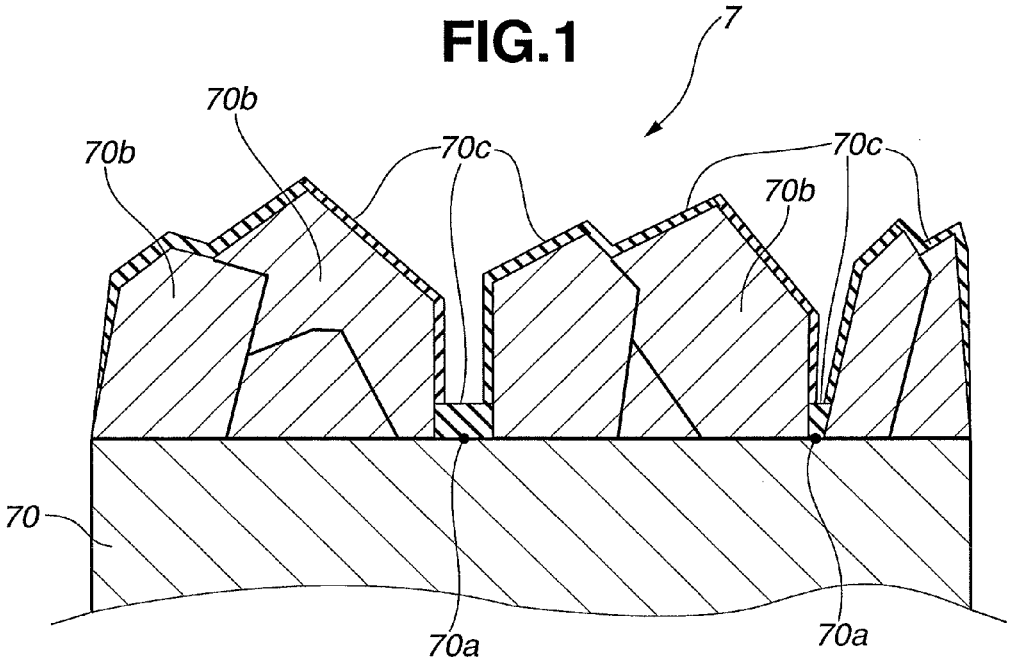
FIG. 1 is an enlarged section view of part of an electrolytic electrode according to one embodiment of the present invention.

FIG. 1 is an enlarged section view of part of the electrolytic electrode (as anode 7) according to one exemplary embodiment of the present invention. The electrolytic electrode (anode 7) according to the present invention includes an electrode substrate 70 having at least a surface thereof formed of a conducting carbon material, a conducting diamond layer 70*b* formed on and covering a part of the surface of the electrode substrate 70, with an exposed part 70*a* of the surface of the electrode substrate 70 being exposed from and uncovered by the conducting diamond layer 70*b*, and a metal fluoride-containing coating layer 70*c* formed on and covering the exposed part 70*a* of the surface of the electrode substrate 70.

The electrolytic electrode (anode 7) according to the present invention is characterized in that the metal fluoride-containing coating layer 70*c* is formed on the exposed part 70*a*, as shown in FIG. 1, so that the exposed part 70*a* can be protected from deposition of a graphite fluoride e.g. $(CF)_n$. In the present embodiment, the metal fluoride-containing coating layer 70*c* is also formed on a surface of the conducting diamond layer 70*b*. By such a configuration, it is possible to perform electrolysis reaction more stably as compared to the case where only the conducting diamond layer 70*b* is formed on the surface of the electrode substrate 70.

There is no particular limitation on the electrode substrate 70 used in the present invention as long as at least the surface of the electrode substrate 70 shows electrical conductivity, chemical resistance and stability to fluorine ions contained in the molten salt inside the electrolytic bath. Examples of the surface material of the electrode substrate are amorphous carbon, graphite, silicon nitride and the like.

There is no particular limitation on the shape of the electrode substrate 70. The shape of the electrode substrate 70 is set as appropriate depending on the shape and space of the electrolytic cell used etc. For example, the electrode substrate 70 can be in plate form, cylindrical form, rod form, spherical form, porous form or the like.

There is also no particular limitation on the process for formation of the conducting diamond layer on the electrode substrate 70. The conducting diamond layer can be formed by any generally known process such as hot filament CVD process, microwave plasma CVD process, plasma arc-jet CVD process or the like. One suitable process is hot filament CVD process, which is known as a typical method for synthesis of a diamond material.

In the case of forming the conducting diamond layer by a gas phase synthesis process such as hot filament CVD process, a mixed gas in which a carbon-containing gas is diluted with hydrogen is used as a raw material for diamond. Examples of the carbon-containing gas are gases of organic compounds such as methane, acetone and alcohols. In order to impart conductivity to the diamond layer, a trace amount of dopant is added to the raw material gas. As the dopant, boron, phosphorous, nitrogen etc. is preferably used. The concentration of the dopant added can be adjusted as appropriate within the range of e.g. 1 to 500000 ppm.

One example of the process for formation of the conducting diamond layer 70*b* on the electrode substrate 70 will be explained below.

A filament inside a hot filament CVD apparatus is heated to a temperature (1800 to 2800° C.) at around which hydrogen radicals are generated. In this apparatus, the electrode substrate 70 is treated under a temperature range (700 to 1000° C.) where the deposition of diamond occurs such that a coating film of conducting diamond is formed on the electrode substrate 70. The feed rate and flow rate of the mixed gas is set as appropriate depending on the size and shape of the apparatus used. Further, the film forming pressure is preferably set to 15 to 760 Torr.

In order to improve the adhesion between the electrode substrate 70 and the diamond layer, it is preferable to grind or polish the surface of the electrode substrate 70 by the use of diamond-containing abrasives etc. Preferably, the electrode substrate 70 has a surface roughness Ra of 0.1 to 20 The term "surface roughness Ra" herein refers to an arithmetic mean surface roughness as defined in JIS B 0601:2001 and can be measured with a stylus type surface roughness tester.

It is further preferable to perform diamond nucleation enhancement treatment on the ground or polished surface of the electrode substrate 70 in order to enhance the uniform growth of the diamond layer. There is no particular limitation on the diamond nucleation enhancement treatment. The diamond nucleation enhancement treatment can be performed by e.g. immersing the electrode substrate 70 in an aqueous solution in which diamond particles are dispersed in ethanol.

Next, the electrolytic cell to which the electrolytic electrode according to the present invention is applicable for synthesis of the fluorine compound will be explained below.

Figure 2:
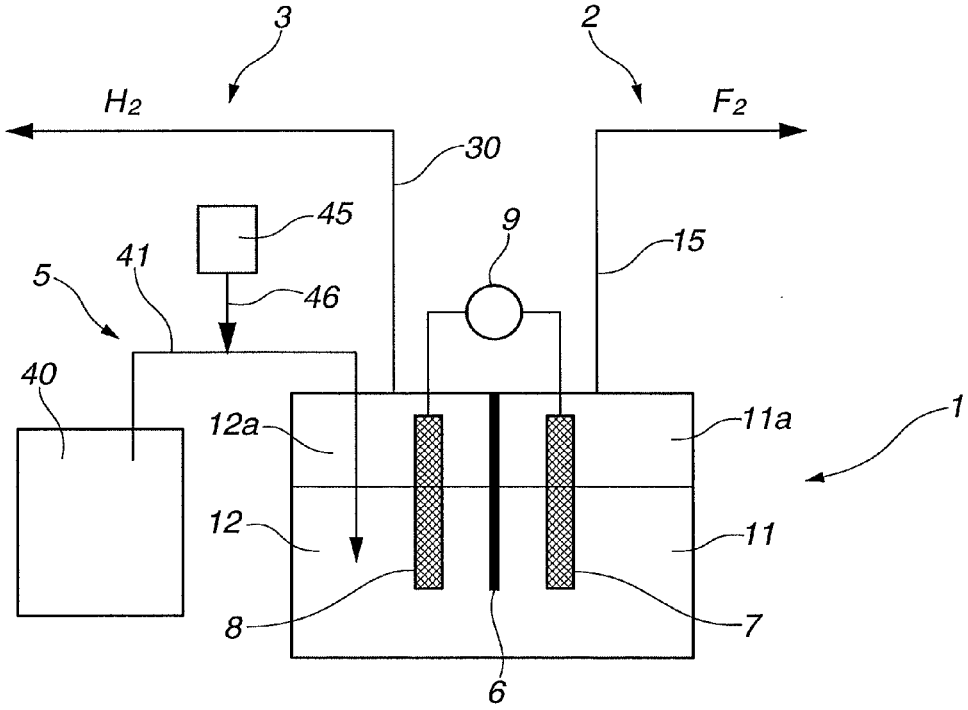
FIG. 2 is a schematic view showing an example of an electrolytic cell to which the electrolytic electrode of FIG. 1 is applicable.

FIG. 2 is a schematic view showing one example of the electrolytic cell to which the electrolytic electrode according to the present invention is applicable. In the following explanation, the electrolytic electrode according to the present invention is referred to as anode 7.

A molten salt containing hydrogen fluoride (HF) is stored in the electrolytic cell 1. The composition of fluorine compound gas generated from the electrolytic cell 1 can be controlled as appropriate by changing the composition of the molten salt stored in the electrolytic cell 1. Examples of the molten salt generally used are those represented by the general formula: KF.nHF (n=0.5 to 5.0). In the case of using a $NH_4F.HF$ molten salt, for example, nitrogen trifluoride ($NF_3$) is obtained as a product. In the case of using a $NH_4F.KF.HF$ molten salt, a mixture of $F_2$ and $NF_3$ is obtained as a product.

In the present embodiment, the synthesis of $F_2$ by the use of a mixture of hydrogen fluoride and potassium fluoride (KF) (abbreviated as "KF.2HF") will be exemplified below.

Inside the electrolytic cell 1, a partition wall 6 is partly immersed in the molted salt to define an anode chamber 11 and a cathode chamber 12. An anode 7 and a cathode 8 are immersed in the molten salt within the anode chamber 11 and the cathode chamber 12, respectively. By the supply of power between the anode 7 and the cathode 8 from a power source 9, there are generated a main product gas containing fluorine gas ($F_2$) as a main component at the anode 7 and a by-product gas containing hydrogen gas ($H_2$) as a main component at the cathode 8. The electrolytic electrode of the present invention is used as the anode 7 as mentioned above. As the cathode 8, an electrode of soft iron, monel or nickel is used.

The space above the liquid surface of the molten salt inside the electrolytic cell 1 is divided into a first gas chamber 11*a* and a second gas chamber 12*a* by the partition wall 6. The fluorine gas generated at the anode 7 and the hydrogen gas generated at the cathode 8 are introduced into the first gas chamber 11*a* and the second gas chamber 12*a*, respectively. The first gas chamber 11*a* and the second gas chamber 12*a* are herein not in gas communication with each other. Namely, the first gas chamber 11*a* and the second gas chamber 12*a* are completely separated by the partition wall 6 so as to prevent reaction by mixing/contact of the fluorine gas and the hydrogen gas. On the other hand, the anode chamber 11 and the cathode chamber 12 are not completely separated by the partition wall 6 and are in communication with each other at a position below the partition wall 6 so as to allow flow of the molten salt between the anode chamber 11 and the cathode chamber 12.

As the melting point of KF.2HF is 71.7° C., the temperature of the molten salt is adjusted to 91 to 93° C. Hydrogen fluoride is vaporized by vapor pressure from the molten salt and mixed into each of the fluorine gas generated at the anode 7 and the hydrogen gas generated at the cathode 8 in the electrolytic cell 1. Thus, each of the fluorine gas generated at the anode 7 and introduced to the first gas chamber 11*a* and the hydrogen gas generated at the cathode 8 and introduced to the second gas chamber 12*a* contains hydrogen fluoride.

A raw material feeding system 5 is provided to feed and fill hydrogen fluoride into the molten salt of the electrolytic cell 1 as a raw material for fluorine gas. The raw material feeding system 5 will be explained below.

The electrolytic cell 1 is connected via a raw material feeding passage 41 to a hydrogen fluoride feeding unit 40, in which the hydrogen fluoride to be fed to the electrolytic cell 1 is stored, so that the hydrogen fluoride is fed from the hydrogen fluoride feeding unit 40 into the molten salt of the electrolytic cell 1 through the raw material feeding passage 41.

A carrier gas feeding passage 46 is connected to the raw material feeding passage 41 so as to feed a carrier gas from a carrier gas feeding unit 45 into the raw material feeding passage 41. The carrier gas is a gas for introducing the hydrogen fluoride into the molten salt. An inert gas such as nitrogen gas is used as the carrier gas. The nitrogen gas is fed together with the hydrogen fluoride into the molten salt of the cathode chamber 12, but is hardly dissolved in the molten salt and is discharged out from the second gas chamber 12*a* through a second main passage 30.

In the above-structured electrolytic cell 1, the electrolytic synthesis of the fluorine compound is conducted by the use of the electrolytic electrode according to the present invention as the anode 7. The electrolytic synthesis includes: a step [1] of adjusting the concentration of metal ions in the molten salt of the electrolytic cell 1 to a given concentration level; a step [2] of immersing the electrolytic electrode (anode 7) in the molten salt in which the concentration of the metal ions has been adjusted to the given concentration level and thereby forming the metal fluoride-containing coating layer 70*c* on the exposed part 70*a* of the electrode substrate 70; and a step [3] of performing electrolysis reaction to synthesize the fluorine compound while forming the metal fluoride-containing coating layer 70*c* on the exposed part 70*a* of the electrode substrate 70.

The step [1] will be first explained below. In the step [1], the concentration of the metal ions in the molten salt of the electric cell 1 is adjusted to the given concentration level by the coexistence of the metal ions in the molten salt. Metal fluoride ions are formed when the metal ions coexist in the molten salt. There is no particular limitation on the technique for coexistence of the metal ions in the molten salt. For example, the metal ions can be allowed to coexist in the molten salt by immersing and dissolving a metal salt such as fluoride or a given amount of metal in the molten salt. The concentration of the metal ions in the molten salt is preferably adjusted to within the range of 10 ppm to 5%.

As the metal ions, there can be used any metal ions capable of forming high-valence metal fluoride ions. Examples of the metal ions are ions of metal elements such as not only Ni but also Fe, Cu, Zn and Al. As the metal fluoride salt, there can be used ordinary fluoride salts such as nickel fluoride, iron fluoride, copper fluoride and zinc fluoride. The above metal elements are preferred because each of these metal elements is capable of forming high-valence ions with fluoride and applying a highly corrosion-resistant coating film by electrolysis reaction. In particular, Ni is preferred as the metal element because of its capability to form a coating film of nickel fluoride with surface smoothness, good film strength and good electrical conductivity.

The step [2] will be next explained below. In the step [2], the conducting diamond-coated electrolytic electrode (anode 7) is immersed in the molten salt of the electrolytic cell 1 in which the concentration of the metal ions has been adjusted to the given concentration level by the coexistence of the metal ions, whereby the metal fluoride-containing coating layer 70*c* is formed on the exposed part 70*a* of the electrode substrate 70. It is feasible in the step [2] to form the metal fluoride-containing coating layer 70*c* just by immersing the electrolytic electrode (anode 7) in the molten salt or by performing electrolysis reaction at a given current density while immersing the electrolytic electrode (anode 7) in the molten salt. In this case, the electrolysis reaction can be performed at a current density of 0.1 to 5 A/dm$^2$.

The metal fluoride-containing coating layer 70*c* formed on the exposed part 70*b* is a coating layer predominantly formed of a fluoride of potassium and metal as represented by the general formula: $K_nMF_m$ (where M is Ni, Fe, Cu, Zn etc.; n is 1 to 3; and m is 1 to 7). Among others, nickel is particularly preferred as the metal. Specific examples of the potassium nickel fluoride are $KNiF_3$, $K_2NiF_4$, $K_{0.12}NiF_3$, $K_3NiF_6$, $K_2NiF_6$, $K_3Ni_2F_7$, $K_2NiF_4$, $K_3NiF_7$, $K_3NiF_5$, $KNiF_4$, $KNiF_5$, $KNiF_6$, $K_2NiF_7$, $K_2NiF_5$ and $K_4NiF_6$.

Specific examples of the other potassium metal fluoride are: in the case where the metal element is iron (Fe), $K_3FeF_6$, $K_{0.25}FeF_3$, $K_{0.6}FeF_3$, $K_2FeF_4$, $K_2Fe_2F_7$, $KFeF_3$, $K_2FeF_6$, $K_2Fe_5F_{17}$, $K_2FeF_5$, $KFeF_4$, $K_{5.25}Fe_{10}F_{30}$, $K_{42}Fe_{80}F_{240}$, $K_{10.5}Fe_{20}F_{60}$, $K_2FeF_5$, $KFeF_6$ and $K_3FeF_4$; in the case where the metal element is zinc (Zn), $KZnF_3$, $K_2ZnF_4$, $K_3Zn_2F_7$, $KZnF_4$ and $K_2ZnF_6$; and, in the case where the metal element is copper (Cu), $KCuF_3$, $K_2CuF_4$, $K_3CuF_6$, $K_2CuF_3$, $K_3Cu_2F_7$ and $KCuF_5$.

In the metal fluoride-containing coating layer 70*c* as represented by the general formula: $K_nMF_m$ (where M is Ni, Fe, Cu, Zn etc.; n is 1 to 3; and m is 1 to 7), potassium (K) may be replaced with lithium (Li).

The step [3] will be explained below. Subsequently to the step [2], the electrolysis reaction is performed at a given current density in the step [3] to synthesize the fluorine compound while further forming the metal fluoride-containing coating layer 70*c* on a surface of the metal fluoride-containing coating layer 70*c* that has been formed on the exposed part 70*a* in the step [2]. The step [3] is advantageous in that the electrolytic synthesis of the fluorine compound proceeds while preferentially forming the metal fluoride-containing coating layer 70*c* on the exposed part 70*a* of the electrode substrate 70 and thereby limiting the growth of a graphite fluoride layer.

Although it is preferable to carry out the step [3] after the step [2], the step [3] may be carried out subsequently to the step [1] without the step [2]. In other words, it is feasible to carry out the formation of the metal fluoride-containing coating layer 70*c* on the exposed part 70*a* by the step [2] before the electrolytic synthesis of the fluorine compound or feasible to simultaneously carry out the electrolytic synthesis of the fluorine compound and the formation of the metal fluoride-containing coating layer 70*c* on the exposed part 70*a* by the steps [1] and [3] without forming the metal fluoride-containing coating layer 70*c* on the exposed part 70*a* in advance of the electrolytic synthesis of the fluorine compound.

As one preferred example, the formation of a potassium nickel fluoride coating layer as the metal fluoride-containing coating layer 70*c* on the exposed part 70*a* of the electrode substrate 70 will be exemplified below.

In the coexistence of nickel ions in the molten salt, the nickel ions form high-valence metal fluoride ions. When the conducting diamond-coated electrolytic electrode is immersed in such a molten salt, a coating film containing potassium nickel fluoride as a main component is formed on the exposed part 70*a* of the electrode substrate 70 on which the conducting diamond layer 70*b* is not formed. A coating film containing potassium nickel fluoride as a main component is also formed on a surface of the conducting diamond layer 70*b*. The resulting coating film layer is high in corrosion resistance, adhesion strength and electrical conductivity.

As the technique for coexistence of the nickel ions in the molten salt, it is feasible to add nickel fluoride ($NiF_2$) as the metal fluoride salt in the molten salt, to immerse and dissolve a metal rod of nickel in the molten salt, or to utilize a reaction vessel of a nickel-containing metal material e.g. Monel as a cathode in the electrolytic cell 1 and thereby elute nickel from the material of the electrolytic cell 1. The concentration of the nickel ions in the molten salt is preferably adjusted to 10 ppm to 5%, more preferably 30 ppm to 1000 ppm. It is unfavorable to set the concentration of the nickel ions in the molten salt to be lower than 10 ppm because the potassium nickel fluoride coating layer may not be sufficiently formed under such a low nickel-ion concentration state. It is also unfavorable to set the concentration of the nickel ions in the molten salt to be higher than 5% because, under such a high nickel-ion concentration state, a sludge of nickel fluoride is likely to occur in the molten salt of the electrolytic cell and build up on the bottom of the electrolytic cell.

It is feasible to form the potassium nickel fluoride coating layer on the exposed part 70*a* of the electrode substrate 70 just by immersing the electrode substrate 70 in the molten salt in which the concentration of the metal ions has been adjusted to the given concentration level. The potassium nickel fluoride coating layer may alternatively be formed by performing electrolysis reaction at a given current density while immersing the electrode substrate in the molten salt.

In the case of forming the potassium nickel fluoride coating layer by electrolysis reaction on the exposed part 70*a* of the electrode substrate 70, a direct current is applied between the anode 7 and the cathode 8 in the electrolytic cell. As the current application conditions, the current density is generally 0.1 to 5 A/dm$^2$, preferably 0.1 to 1 A/dm$^2$. The current application time is varied depending on the sizes and numbers of the electrodes, used, the size of the electrolytic cell used etc. As a guide, the electrolysis reaction can be performed by constant-current electrolysis technique for 0.1 hour or longer. It is unfavorable to set the current density to be higher than 5 A/dm$^2$ because, under such a high current density, the graphite fluoride layer is likely to be formed before the deposition of the potassium nickel fluoride coating layer on the exposed part 70*a*.

For the formation of the sufficiently stable potassium nickel fluoride coating layer, the current application time is preferably set to be at least 1 hour when the current density is in the above range.

There is no particular limitation on the current application time. It is however unfavorable to set the current application time to be longer than 10 hours because such long-time current application leads to deteriorations in power consumption efficiency and productivity.

After the sufficient, stable potassium nickel fluoride coating layer is formed on the exposed part 70*a* of the electrode substrate 70 in the above step, the current density can be adjusted freely according to the target product yield. For example, the current density can be adjusted to within the range of 0.1 to 1000 A/dm$^2$. The term "current density (A/dm$^2$)" herein refers to a value of current applied (A)/apparent electrode area (dm$^2$).

EXAMPLES

The present invention will be described in more detail below by way of the following examples. It is however noted that the following examples are illustrative and are not intended to limit the present invention thereto.

Example 1

Using a hot filament CVD apparatus, an electrolytic electrode (anode 7) coated with boron-doped conducting diamond (also simply referred to as "boron-doped diamond") was produced by the following procedure. Herein, an amorphous carbon substrate was used as an electrode substrate 70.

The entire front and back surfaces of the electrode substrate 70 were polished with the use of diamond-containing abrasives. The polished electrode substrate 70 was immersed in an ultrasonic cleaner filled with an ethanol aqueous solution in which diamond particles of 5 nm average size were dispersed, thereby performing diamond nucleation enhancement treatment on the entire surfaces of the electrode substrate 70.

After that, the electrode substrate 70 was dried and placed under a filament inside the hot filament CVD apparatus. Film forming operation was then conducted for 8 hours under the conditions that: the temperature of the filament was maintained at 2200° C.; the pressure inside the CVD apparatus was maintained at 30 Torr; and a mixed gas containing 1.0 vol % methane gas and 3000 ppm trimethylboron gas in hydrogen gas flowed in the CVD apparatus. In this operation, boron-doped diamond was applied to the electrode substrate 70. The temperature of the electrode substrate 70 was herein set to 850° C. The above operation was repeated in a similar manner, whereby a coating film of boron-doped diamond (as a conducting diamond layer 70*b*) was formed on the front and back surfaces of the electrode substrate 70.

When the electrode substrate 70 with the boron-doped diamond coating film (conducting diamond layer 70*b*) was observed by a scanning electron microscope (SEM), there was seen an exposed part 70*a* to which the boron-doped diamond was not applied on a surface of a part of the electrode substrate 70.

Nickel fluoride was added as a metal fluoride into a molten salt of KF-2HF system such that the concentration of nickel ions in the molten salt was adjusted to 100 ppm. In the resulting molten salt, the electrolysis electrode (the electrode substrate 70 with the boron-doped diamond coating film) obtained by the above film forming process was set as an anode; and a nickel plate was set as a cathode 8. Constant-current electrolysis was then performed for 5 hours at a current density of 1 A/dm$^2$, whereby a coating film of potassium nickel fluoride (as a metal fluoride-containing coating layer 70*c*) was deposited on the exposed part 70*a* of the electrode substrate 70 to which the boron-doped diamond was not applied.

Subsequently, the electrolysis reaction was performed for 24 hours under the conditions that the current density was raised to 20 A/dm$^2$. In this reaction, the electrolytic voltage was 8 V±0.1 V before and after a lapse of 24 hours.

It has been shown by the above results that it was possible to perform the electrolysis reaction stably, with a small change in electrolytic voltage before and after the electrolysis reaction, while limiting the growth of a graphite fluoride layer. When a portion of the electrode substrate 70 after the electrolysis reaction was taken as a sample and observed by SEM, there was seen no separation of the conducting diamond layer and no corrosion of the electrode substrate 70.

Example 2

An electrolytic electrode (anode 7) coated with boron-doped diamond was produced in the same manner as in Example 1, except that the concentration of nickel ions in the molten salt of KF-2HF system was adjusted to 30 ppm. Using the thus-obtained electrode, electrolysis reaction was performed by the same procedure under the same electrolysis conditions as in Example 1. The electrolytic voltage was 8 V±0.1 V before and after a lapse of 24 hours.

It has been shown by the above results that it was also possible to perform the electrolysis reaction stably, with a small change in electrolytic voltage before and after the electrolysis reaction, while limiting the growth of a graphite fluoride layer even in the case where the nickel ion concentration was adjusted to 30 ppm. When a portion of the electrode substrate after the electrolysis reaction was taken as a sample and observed by SEM in the same manner as above, there was seen no separation of the conducting diamond layer and no corrosion of the electrode substrate.

Comparative Example 1

An electrolytic electrode (anode 7) coated with boron-doped diamond was produced in the same manner as in Example 1, except that the concentration of nickel ions in the molten salt of KF-2HF system was adjusted to 5 ppm. Using the thus-obtained electrode, electrolysis reaction was performed by the same procedure under the same electrolysis conditions as in Example 1. The electrolytic voltage was 8 V at the time of initiation of the electrolysis reaction, but was 9 V after a lapse of 24 hours.

As is seen from these results, the deposition of a graphite fluoride layer took place preferentially to the formation of the potassium nickel fluoride coating layer on the surface of the electrode substrate 70 so that there occurred an increase in electrolytic voltage under the electrolysis reaction in the case where the nickel ion concentration was adjusted to 5 ppm.

Although the present invention has been described with reference to the above exemplary embodiments, the present invention is not limited to these exemplary embodiments. Various modification and variation of the embodiments described above will occur to those skilled in the art, in light of common knowledge, within the scope of the present invention.

DESCRIPTION OF REFERENCE NUMERALS

1: Electrolytic cell
2: Fluorine gas feeding system
3: By-product gas feeding system
5: Raw material feeding system
7: Anode
8: Cathode
11*a*: First gas chamber
12*a*: Second gas chamber
15: First main passage
30: Second main passage
70: Electrode substrate
70*a*: Exposed part
70*b*: Conducting diamond layer
70*c*: Metal fluoride-containing coating layer

The invention claimed is:

1. An electrode for electrolytic synthesis of a fluorine compound by the use of an electrolytic bath of a hydrogen fluoride-containing molten salt, comprising:

an electrode substrate formed of a conductive carbon material;

a conducting diamond layer formed on a part of a surface of the electrode substrate; and a metal fluoride-containing coating layer having electrical conductivity formed on an exposed part of the surface of the electrode substrate that is uncovered by the conducting diamond layer, wherein the metal fluoride-containing layer is predominantly formed of a potassium metal fluoride as represented by the general formula: $K_nMF_m$, wherein M is Ni, Fe, Cu, Zn or Al; n is 1 to 3; and m is 1 to 7.

2. A method for electrolytic synthesis of a fluorine compound, comprising;

providing an electrolytic electrode, the electrolytic electrode comprising an electrode substrate formed of a conducive carbon material and a conducting diamond layer formed on a part of a surface of the electrode substrate; and immersing the electrolytic electrode as an anode in an electrolytic bath of a hydrogen fluoride-containing molten salt, thereby synthesizing the fluorine compound while forming a metal fluoride-containing coating layer having electrical conductivity on an exposed part of the electrode substrate that is uncovered by the conducting diamond layer wherein the metal fluoride-containing layer is predominantly formed of a potassium metal fluoride as represented by the general formula: $K_nMF_m$, wherein M is Ni, Fe, Cu, Zn or Al; n is 1 to 3; and m is 1 to 7.

3. The method for electrolytic synthesis of the fluorine compound according to claim 2, wherein the method comprises:

(1) adjusting the concentration of metal ions in the electrolytic bath of the hydrogen fluoride-containing molten salt to 30 ppm to 1000 ppm;

(2) immersing the electrolytic electrode in the electrolytic bath of the hydrogen fluoride-containing molten salt and thereby forming the metal fluoride-containing coating layer on the exposed part of the electrode substrate that is uncovered by the conducting diamond layer; and (3) of synthesizing the fluorine compound while forming the metal fluoride-containing coating layer on the exposed part.

4. The method for electrolytic synthesis of the fluorine compound according to claim 3, wherein the metal ions in the electrolytic bath of the hydrogen fluoride-containing molten salt are nickel ions, and wherein the metal fluoride-containing coating layer contains a fluoride of nickel.

* * * * *